US006514156B1

(12) United States Patent
Zorzi

(10) Patent No.: US 6,514,156 B1
(45) Date of Patent: Feb. 4, 2003

(54) TUBE AND GOLF CLUB WITH HANDLE MADE OF SAID TUBE

(76) Inventor: Silvano Zorzi, Curtibergstrasse 133 e, Wagen 8646 (CH)

( * ) Notice: Subject to any disclaimer, the term of this patent is extended or adjusted under 35 U.S.C. 154(b) by 0 days.

(21) Appl. No.: 09/485,205

(22) PCT Filed: Aug. 3, 1998

(86) PCT No.: PCT/CH98/00328

§ 371 (c)(1),
(2), (4) Date: May 5, 2000

(87) PCT Pub. No.: WO99/07446

PCT Pub. Date: Feb. 18, 1999

(30) Foreign Application Priority Data

Aug. 5, 1997 (CH) ..... 1852/97

(51) Int. Cl.[7] ..... A63B 53/00

(52) U.S. Cl. ..... 473/319; 473/320; 428/36.3; 428/36.9

(58) Field of Search ..... 473/320, 316–319, 473/321, 564, 565, 567; 280/819; 43/18.1; 428/36.3, 36.9, 36.91; 264/632; 156/187–188

(56) References Cited

U.S. PATENT DOCUMENTS

| | | | |
|---|---|---|---|
| 3,457,962 | A | 7/1969 | Shobert |
| 5,188,872 | A | 2/1993 | Quigley |

FOREIGN PATENT DOCUMENTS

| | | | |
|---|---|---|---|
| EP | 0072256 | A2 | 2/1983 |
| EP | 0662391 | A2 | 7/1995 |
| EP | 0747098 | A1 | 12/1996 |
| GB | 1327246 | | 8/1973 |
| GB | 227178 | A | 7/1990 |
| WO | WO 91/14480 | | 10/1991 |

*Primary Examiner*—Stephen Blau
(74) *Attorney, Agent, or Firm*—Townsend and Townsend and Crew LLP

(57) ABSTRACT

The tube (6) comprises a wall which is composed of a plurality of layers (2; 3; 5; 4). Longitudinally extending wires (3) are provided in the wall. At least one layer (2, 4) which is wound over the circumference of the tube (6) is present inside and/or outside with respect to the longitudinally extending wires (3).

14 Claims, 5 Drawing Sheets

[A-A]

TUBE AND GOLF CLUB WITH HANDLE MADE OF SAID TUBE

BACKGROUND OF THE INVENTION

1. Field of the Invention

The invention relates to a tube, and to a golf club using a tube in accordance with the present invention.

2. Description of the Prior Art

Tubes are known which are manufactured through drawing of metal or through winding of mats of fiber-reinforced epoxy resin materials or through winding of fibers. These tubes are relatively light, but have a rather moderate bending elasticity. The tubes have poor oscillation damping properties. The damping properties must be improved subsequently through the installation or attachment of damping elements. All these tubes have insufficient damping properties for certain uses.

Conventional shafts of golf clubs are also e.g. either drawn metal tubes or tubes which are wound from fiber materials. Metal tubes are distinguished by good elasticity, but have however a relatively high weight and poor damping properties. Wound tubes of fiber materials are distinguished by low weight in the presence of moderate elasticity; the damping properties are however insufficient for many uses. The damping properties of tubes of fiber materials manufactured by a conventional method, such as drawing or winding, are hardly sufficient and must therefore be built in subsequently.

SUMMARY OF THE INVENTION

An object of the present invention is to create a tube of high elasticity, good torsion behavior and low weight. At the same time the tube should have good oscillation damping properties. It is furthermore an object of the present invention to create a golf club with a shaft which has high elasticity, good torsion stiffness and low weight.

A tube in accordance with the invention can for example be manufactured as follows. A first fiber layer is wound onto a winding body such as, for instance, a winding spike. This can take place with a winding machine which winds the threads or fibers one next to the other or which winds each winding at a specific distance from the next one on the winding spike. This first winding layer or wound layer respectively can be coated and impregnated with an epoxy resin. Then the longitudinal wires can be applied to the wound layer. The longitudinal wires can in turn be coated with epoxy resin and be embedded in the latter. The longitudinal wires together with the epoxy resin lying between them can thus form a longitudinal wire layer. Over the longitudinal wires further wound layers and onto these longitudinal wires can again be applied until the tube has the correct construction. If an only loosely wound layer lies over a wire layer and further wires are laid onto this loosely wound layer in such a manner that the wires of the second layer of longitudinal wires lie between those of the first layer of longitudinal wires, the longitudinally extending wires of the first and the second layer can be combined to a layer with a further, hard wound layer. The loosely wound layer then extends in wave shape about the longitudinally extending wires of this combined layer. The loosely wound layer can alternately extend over the one wire and under the next, adjacent wire. It is however also conceivable that the loosely wound layer extends over and under more than one adjacent longitudinal wire. A large number of structures are conceivable here.

The wires or the fibers for the tube can for example consist of metal, carbon fiber, glass of kevlar. The wires can be individual wires, but the construction of these wires can also be stranded, woven, cable-like, or the wire can be a braid. For example wires such as are used for piano strings are well suited. It is also conceivable to use wired of different materials and/or with different construction in one tube. The wires themselves can in turn be designed in tube or tubelet shape. The wires advantageously have a diameter of approximately 0.2 mm to 0.5 mm, with wires of other diameters naturally also being suitable.

The tube in accordance with the invention has the required properties such as high elasticity and high torsion strength at low weight which are for example necessary for the shaft of a golf club. Moreover, the oscillation damping properties can when required be varied with simple means and measures by installing or applying damping elements at specific positions. Foam materials are suitable as damping elements. In the interior of the tube for example a granulate of elastomer, such as latex, can be used. The granulate can be embedded in a foam material.

The tube in accordance with the invention is extremely resistant to bending and buckling, and thus has a good bending resistance strength. Moreover, the tube has very good tensile strength properties.

DETAILED DESCRIPTION OF SPECIFIC EXEMPLARY EMBODIMENTS

Figure 1:
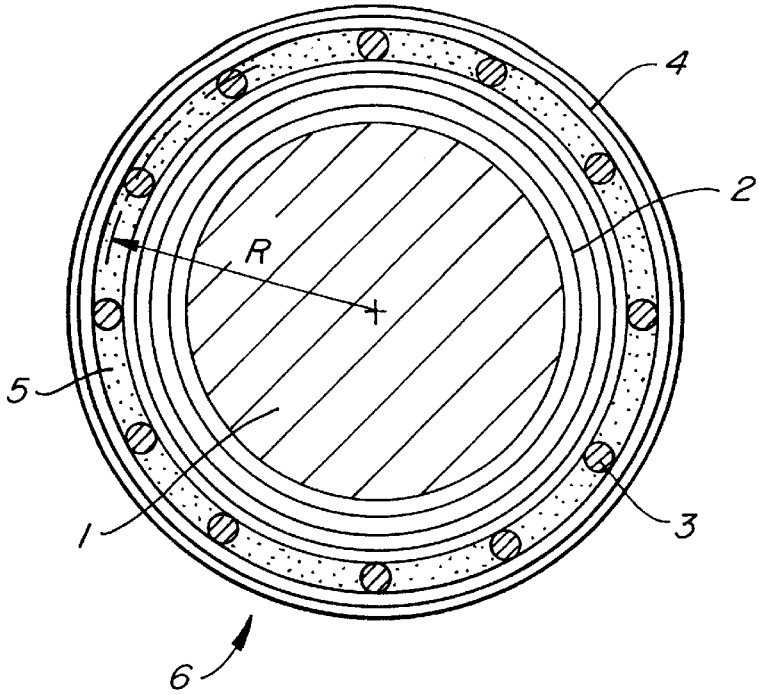
FIG. 1 is a cross-section through a tube.

Metal wires 3, preferably of spring steel or titanium, are arranged at a radius R about the center of the tube 6 in the longitudinal direction of the tube 6 of FIG. 1. Through the arrangement of the metal wires at a radius R a high stiffness of the tube 6 results which, with increasing radius R, likewise increases.

Figure 4:
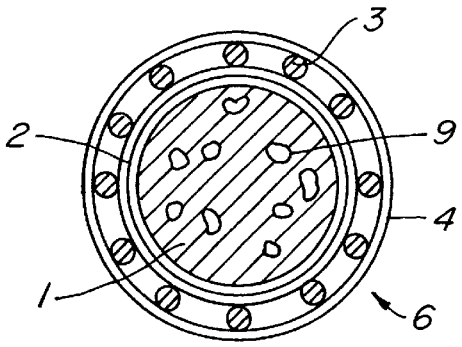
FIG. 4 is a cross-section through a further tube.

The core of the tube 6 can be of a foam material 1 and can also serve as a carrier core for the first wound fiber material zone 2. This foam material core 1 also serves at the same time for damping the oscillations. The damping effect can be increased in that damping bodies 9, preferably rubber granulate, are embedded in the foam material core 1, as is shown in FIG. 4. The tube 6 can also be completely filled with a damping body.

Any windable fiber-like, wire-like or thread-like material such as glass fibers, carbon fibers, kevlar, textile threads, plastic threads or filament threads can be used as a fiber material for the wound layer.

The first fiber material zone 2, preferably carbon fibers, is wound together with an adhesive onto the foam material core 1 or a winding spike, FIG. 1.

Onto the fiber material zone 2 there follow the metal wires 3, FIG. 1. A plurality of layers of metal wires 3 are also possible. These metal wires 3 are applied by means of special devices. These devices and the method will be precisely described below. A plurality of fiber material zones and/or zones with metal wires can be provided in the wall of a tube. In a following step the fiber material zone 4 is wound over the metal wires 3 with an adhesive, FIG. 1.

The space between the fiber material zones 2 and 4 and between the metal wires 3 is filled with adhesive.

The entire tube 6 is, as described above, manufactured stepwise and in a single uninterrupted fabrication process. After the hardening of the adhesive the tubes 6 are then finished, i.e. cut to length, printed, etc.

Figure 5A:
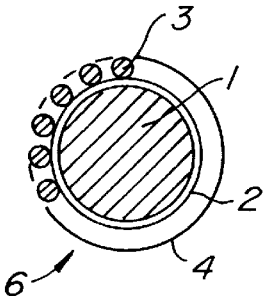
FIGS. 5*a* to *c* illustrate details pertaining to different kinds of the construction of the tube.
Figure 5B:
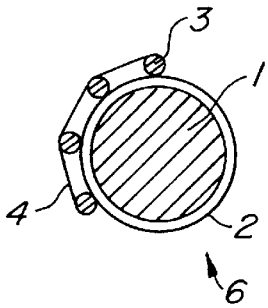
Figure 5C:
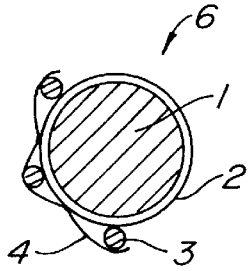

Depending on the number of the metal wires 3 the outer contour of the tube 6 can also be designed to be round, have a polygonal course or to be wave shaped, FIGS. 5*a* to *c*. The wave-shaped outer contour, as is shown in FIG. 5*c*, can for example be obtained with a shaping tool in which the tube is hardened.

Since the tubes 6 e.g. in a golf club are stressed torsionally only in a preferred direction, the fiber material zones 2 and 4 can be wound preferably in one direction. Together with the use of metal wires 3 this yields a slender construction and thus a great saving of fiber materials.

The tubes 6 can also be constructed without a foam material core 1. If the foam material core is omitted, then a special, later removable winding spike can be used for the winding.

Figure 6A:
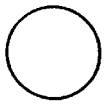
FIGS. 6*a* to *f* illustrate different shapes of tube cross-sections.
Figure 6B:
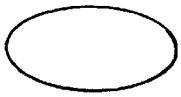
Figure 6C:
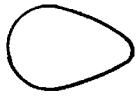
Figure 6D:
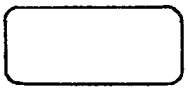
Figure 6E:
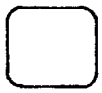
Figure 6F:
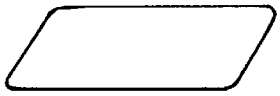

The tube cross-sections can be formed in any desired manner. FIGS. 6*a* to *f* show only several examples. FIG. 6*a* shows a circular cross-section. FIG. 6*b* shows an oval or elliptical cross-section, respectively. FIG. 6*c* shows a drop-shaped or egg-shaped cross-section, respectively, FIG. 6*d* a rectangular cross-section, and FIG. 6*e* a square cross-section. FIG. 6*f*, finally, shows a parallelepiped cross-section.

Figure 7A:
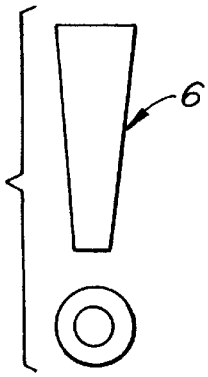
FIGS. 7*a* to *d* illustrate different shapes of tube profiles.
Figure 7B:
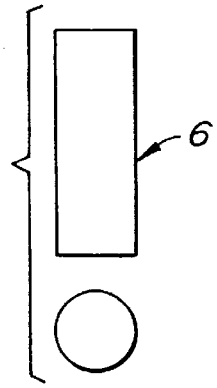
Figure 7C:
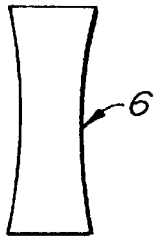
Figure 7D:
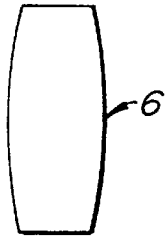

In the longitudinal direction the tubes 6 can also be formed differently. FIG. 7 shows several examples. FIG. 7*a* shows in a schematic cross-section a conical tube, FIG. 7*b* a cylindrical tube, FIG. 7*c* a concave and FIG. 7*d* a convex or barrel-shaped tube.

Figure 2:
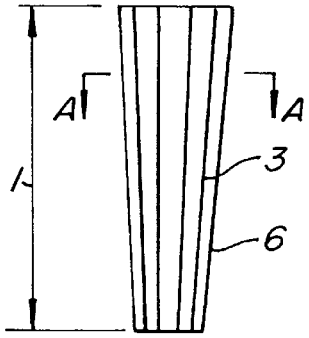
FIG. 2 is a conical tube in a side view.
Figure 3:
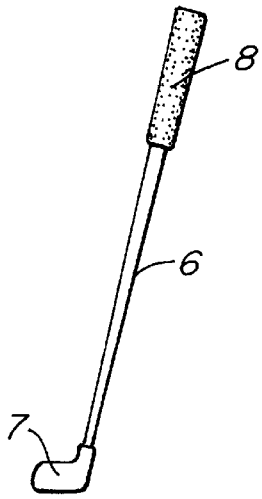
FIG. 3 is a golf club with a conical tube.
Figure 2A:
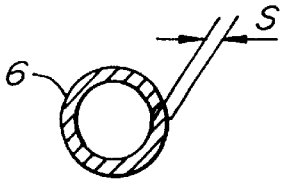
FIG. 2*a* is a cross-section in accordance with the line A—A through the tube of FIG. 2.

As illustrated in the longitudinal view of FIG. 2, the wall thickness of the tube 6 can be constant over the entire length l or it can taper over the length l.

Figure 8:
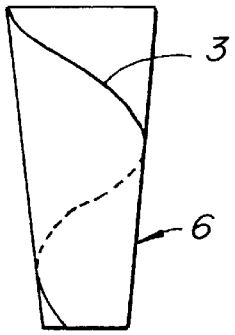
FIG. 8 is a schematic illustration of an embodiment of an arrangement of wires for the tube.

If the tube 6 is to have a high torsion resistance moment, that is, high resistance to being twisted, the metal wires 3 can also be built in the wall to be twisted/distorted relative to the longitudinal direction of the tube 6, which is illustrated schematically in FIG. 8.

Instead of metal wires 3, fiber materials can also be used and thus, metal wires 3 may be replaced with fibers in the present invention.

Figure 9A:
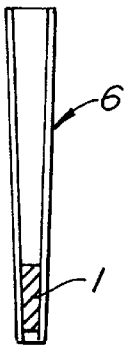
FIGS. 9*a* to *c* illustrate three cross-sections through the tube with one filler body each of foam material, each at a different position.
Figure 9B:
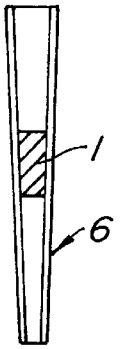
Figure 9C:
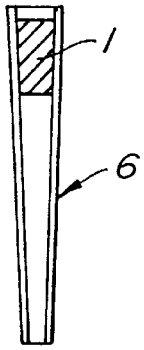

The damping means, e.g. a foam material core 1 or the foam material core 1 with embedded damping bodies 9, such as rubber granulate, can also be applied to be only partially distributed over the length l, which is illustrated schematically in FIG. 9. A plurality of damping bodies 9 with different construction and/or of different materials can also be present in a tube 6.

Figure 10A:
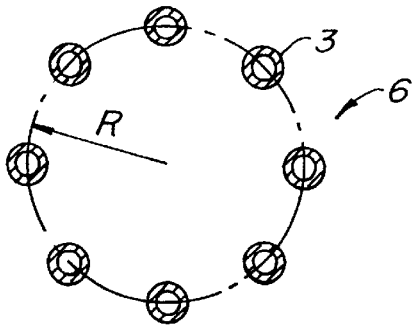
FIGS. 10*a* to *f* illustrate in schematic cross-sections, different kinds of wires and arrangements of the wires, as well as cross-sections through a tube in different steps of the manufacture.
Figure 10B:
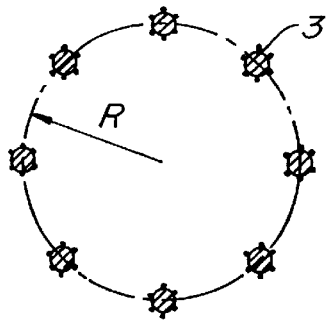
Figure 10C:
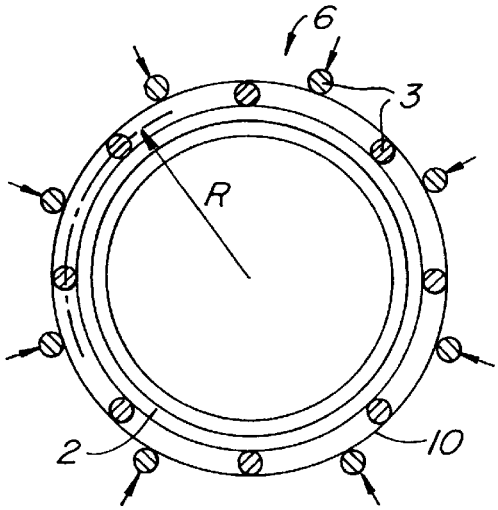
Figure 10D:
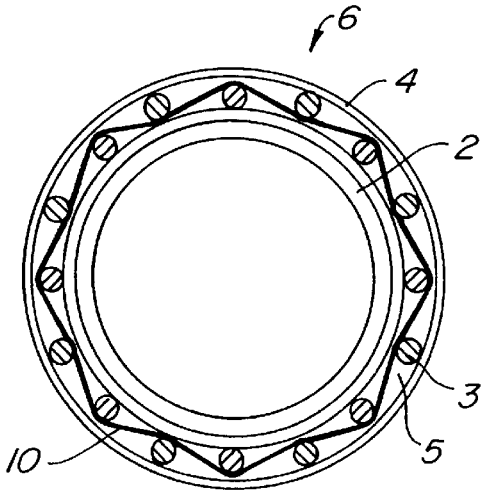

In FIG. 10*a* the longitudinal wires are themselves formed as tubelets. Longitudinal wires with a stranded structure are shown in FIG. 10*b*. FIG. 10*d* shows the design of a tube in which a winding layer 10 alternately encloses inwardly and outwardly the longitudinally extending wires. How a winding layer zone of this kind can be produced is shown in FIG. 10*c*. The loosely wound winding layer 10 lies on the inner wires 3, and the outer wires 3 lie on the winding layer 10. If the subsequent, outer winding layer 4 is hard wound, the wires 3 are brought into the layer between the outer winding layer zone 4 and the inner winding layer zone 2, as is shown in FIG. 10*d*. The wires 3 could also be pressed with a pressing mold into a layer 3 between the outer winding layer zone 4 and the inner winding layer zone 2. It is also possible to arrange the inwardly and outwardly lying wires 3 in such a manner relative to one another that the wires lying inwardly and outwardly in relation to the winding layer 10 lie at different radii R, i.e. that they have different distances from the center of the tube.

Figure 10E:
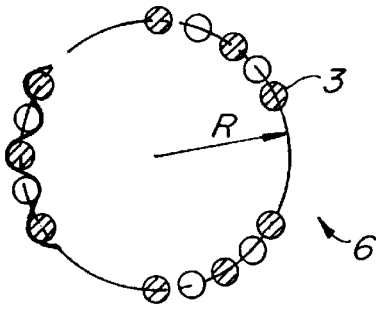
Figure 10F:
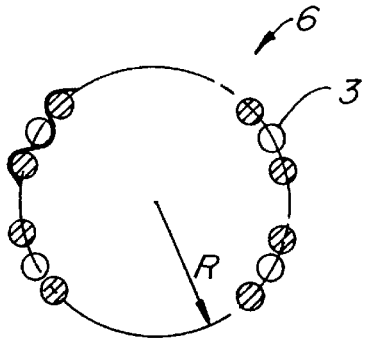

FIG. 10*e* shows schematically the arrangement of the wires 3 into three groups which are distributed over the periphery. Finally, FIG. 10*f* shows an arrangement of wires 3 into four groups which are arranged at different angular distances from one another. All groups have the same distance from the central axis of the tube. The groups of longitudinally extending wires could also have different distances from the central axis of the tube.

Figure 11:
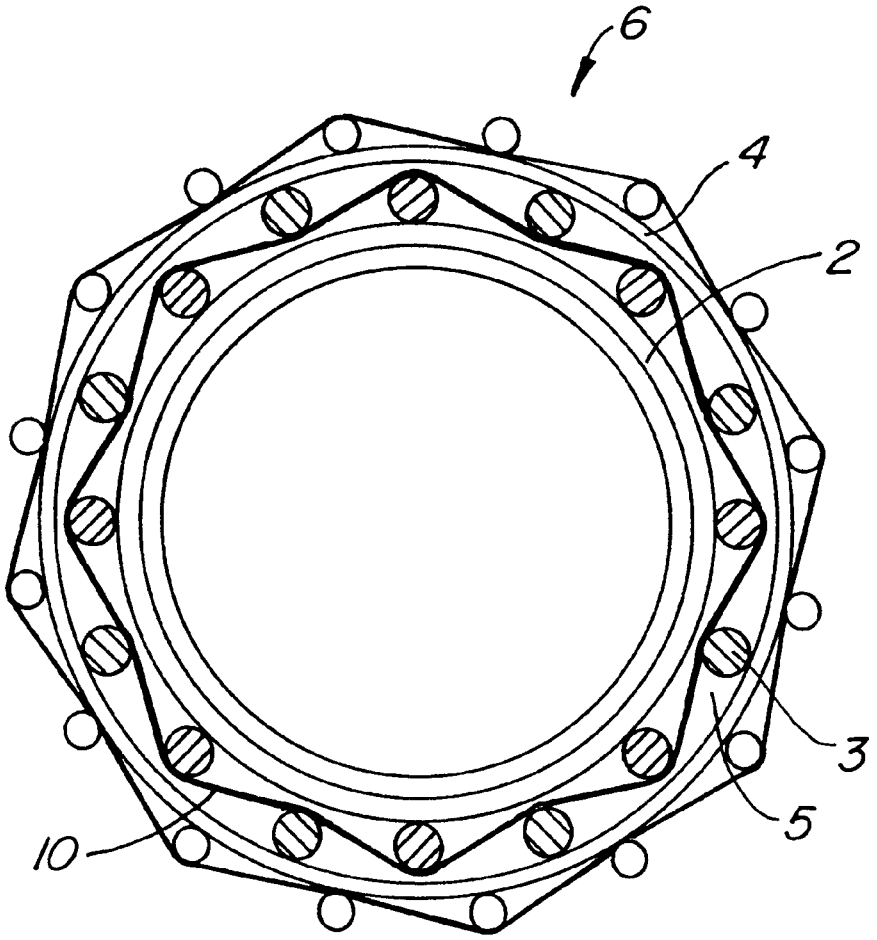
FIG. 11 is a cross-section through a tube in accordance with the present invention, wherein the tube includes a plurality of layers of wires.

FIG. 11 illustrates an embodiment of a tube in accordance with the present invention, wherein the tube includes a plurality of layers of wires.

What is claimed is:

1. A tube with a wall that is composed of a plurality of layers, comprising:

an inner winding layer zone;

inner longitudinally extending wires or fibers arranged on the outside of said inner winding zone;

a winding layer, wound on the inner longitudinally extending wires or fibers;

outer longitudinally extending wires or fibers arranged on the outside of the wound winding layer; and an outer winding layer wound on the outer longitudinally extending wires or fibers, the outer winding layer forcing the outer longitudinally extending wires or fibers in between the inner longitudinally extending wires or fibers.

2. A tube in accordance with claim 1, the layers being impregnated with at least one of epoxy resin and adhesive.

3. A tube in accordance with claim 1, wherein the longitudinally extending wires or fibers are arranged circularly at a distance from the center of the tube.

4. A tube in accordance with claim 1, wherein the tube has a circular cross-section, and wherein the inner longitudinally extending wires or fibers and the outer longitudinally extending wires or fibers have different distances from the center of the tube.

5. A tube in accordance with claim 1, manufactured as a wound body, comprising at least one damping element made of oscillation damping material in the interior of the tube.

6. A tube in accordance with claim 1, having a polygonal cross-section, in which the wires or fibers determine the outer contour of the tube and a wire or fiber extends in the region of each corner edge of the tube.

7. A tube in accordance with claim 1, having at least one of a cross-section which varies in the longitudinal direction and a wall thickness which varies in the longitudinal direction.

8. A tube in accordance with claim 1, wherein the wires or fibers which are longitudinally arranged in the wall of the tube extend at an angle relative to the jacket line.

9. A tube in accordance with claim 8 wherein the wires or fibers are arranged helically.

10. A tube in accordance with claim 1, comprising a plurality of or more layers of wires or fibers which extend longitudinally.

11. A tube in accordance with claim 1, wherein the wires or fibers which extend longitudinally in the wall of the tube consist of at least one of metal, plastic, carbon fibers, glass or a textile material.

12. A tube in accordance with claim 1, comprising longitudinally extending wires or fibers which are executed in one of a stranded, woven, cable-like, tubelet-like, tubular-strand-like manner.

13. A tube in accordance with claim 3 wherein the longitudinally extending wires or fibers are arranged circularly at equal spacing from one another.

14. A golf club comprising a shaft made of a tube with a wall that is composed of a plurality of layers, the tube comprising:

an inner winding layer zone;

inner longitudinally extending wires or fibers arranged on the outside of said inner winding zone;

a winding layer, wound on the inner longitudinally extending wires or fibers;

outer longitudinally extending wires or fibers arranged on the outside of the loosely wound winding layer; and an outer winding layer wound on the outer longitudinally extending wires, the outer winding layer forcing the outer longitudinally extending wires in between the inner longitudinally extending wires.

* * * * *